US006017274A

United States Patent [19]

Sherman et al.

[11] Patent Number: 6,017,274

[45] Date of Patent: Jan. 25, 2000

[54] METHOD OF FORMING A FASTENER

[75] Inventors: Russell G. Sherman, Santa Monica; H. Thomas Patton, San Fernando, both of Calif.

[73] Assignee: Automotive Racing Products, Inc., Oxnard, Calif.

[21] Appl. No.: 08/922,232

[22] Filed: Sep. 2, 1997

[51] Int. Cl.[7] ..... B21H 3/02

[52] U.S. Cl. ..... 470/16; 470/8; 470/11; 470/31

[58] Field of Search ..... 470/8–12, 16, 470/17, 31–33

[56] References Cited

U.S. PATENT DOCUMENTS

| | | | |
|---|---|---|---|
| 2,030,290 | 2/1936 | Friedman | 470/16 |
| 2,763,370 | 9/1956 | Kriedler | 470/16 |
| 3,072,933 | 1/1963 | Carlson | 470/16 |
| 3,767,385 | 10/1973 | Slaney | 75/122 |
| 3,926,687 | 12/1975 | Gondo et al. | 148/12 |
| 4,045,644 | 8/1977 | Shafer et al. | 219/119 |
| 4,296,512 | 10/1981 | Kilinskas et al. | 10/27 |
| 4,563,222 | 1/1986 | Sugita et al. | 148/12 |
| 4,649,728 | 3/1987 | LaCount et al. | 72/85 |
| 4,909,860 | 3/1990 | England et al. | 148/11.5 |
| 5,342,459 | 8/1994 | Klemp et al. | 148/690 |
| 5,360,496 | 11/1994 | Kuhlman et al. | 148/677 |
| 5,374,323 | 12/1994 | Kuhlman et al. | 148/677 |
| 5,453,139 | 9/1995 | Gallagher, Jr. | 148/651 |
| 5,476,555 | 12/1995 | Erickson | 148/410 |
| 5,496,425 | 3/1996 | Gallagher, Jr. | 148/651 |
| 5,509,979 | 4/1996 | Kimura | 148/421 |
| 5,538,566 | 7/1996 | Gallagher, Jr. | 148/584 |
| 5,637,159 | 6/1997 | Erickson | 148/410 |

FOREIGN PATENT DOCUMENTS

| | | | |
|---|---|---|---|
| 5-318018 | 12/1993 | Japan | 470/17 |

*Primary Examiner*—Ed Tolan
*Attorney, Agent, or Firm*—Cislo & Thomas LLP

[57] ABSTRACT

In a first embodiment, a method for forming a hardened fastener having a hardened fastener head. Alloys made of cobalt, nickel, chromium, and molybdenum have very high hardnesses while maintaining ductility. Metals conforming to the chemistry of AMS 5844 and AMS 5842 are disclosed as the preferred materials. These hardnesses are also maintained at high temperatures. In order to form a head upon such materials, a fastener blank is first initially hardened by cold reduction twenty to thirty percent (20%–30%). A fastener head is then formed in the fastener blank by additional cold forging. The remaining shank portion of the fastener blank is cold worked in a third process with the entire three-part cold forging process cold reducing the material forty-eight to fifty percent (48%–50%). Additional hardness may be obtained by heating the material in a temperature range between ca. 1200° F. and 1300° F. In another embodiment, the head may be hot forged for otherwise unworkable materials or alternative hardening techniques may be used prior to cold forging the fastener head. A fastener so formed by the methods set forth herein is also contemplated as being within the scope of the present invention. In still another embodiment a nickel-based alloy is preliminarily heat treated to 180,000 psi and thereafter cold worked using the method of the invention to obtain a high strength fastener.

32 Claims, 1 Drawing Sheet

METHOD OF FORMING A FASTENER

BACKGROUND OF THE INVENTION

1. Field of the Invention

This invention relates to fasteners such as nuts, bolts, and the like, and more particularly to a hardened fastener that is specially formed to take advantage of limitations in present-day machining processes to realize optimum hardness in the fastener.

2. Description of the Related Art

Metal alloys formed from cobalt, and/or nickel, chromium, and molybdenum such as those known in the art as MP35N, MP159, and such alloys made in conformance with the AMS 5844, and AMS 5842 standards are known for their hardness once they have been cold reduced. Similar material known as Custom Age 625 PLUS®, which is a nickel-based alloy, are also useful. Cold forging, or cold working, is a process by which metals, alloys, and the like are mechanically treated as by rolling, swaging, or drawing so that the overall cross-sectional area is reduced. Generally, the cold reduction converts face-centered cubic (FCC) crystals present in the alloy to hexagonal close-packed (HCP) crystals. This provides increased mechanical strength, although it can also lead to brittleness and result in a decrease in structural integrity under stress.

There is a class of materials based upon cobalt, nickel, chromium, and molybdenum that experience high strength upon cold-working. These materials also maintain their high strength under hot conditions. These materials include those listed above, namely, MP35N, MP159, Custom Age 625 PLUS® and alloys formed under the AMS 5844, and AMS 5842 standards.

When annealed, these alloys may become soft. However, by cold working, their strength can be increased to obtain tensile strengths over 250,000 psi. Additional heat treating can also further enhance the strength up to as high as 280,000 psi.

Such hardnesses become increasingly difficult for machine dies, tools, and the like to produce further cold work. It can be seen, therefore, that the art is advanced by providing hardened fasteners whose heads are not softened by hot forging, yet can be worked so that the greatest hardness available through cold working is realized through the fastener. It would be to some advantage to realize such a fastener, and the process by which it might be achieved. By providing such a fastener, parts or components requiring fasteners with a high degree of hardness can be attached to one another and not suffer disassembly or failure during stressful or thermally energetic circumstances.

SUMMARY OF THE INVENTION

The present invention resides in a method for forming a fastener with a high degree of hardness that cannot be achieved by first entirely hardening the fastener blank and working it into its final shape and form after such hardening.

A fastener blank made of Custom Age 625 PLUS®, MP35N, MP159, cobalt-nickel-chromium-molybdenum alloys, having the chemical makeup of AMS 5844 and AMS 5842 standard materials is first cold worked by cold reduction approximately twenty to thirty percent (20%–30%). This imparts a yield strength into the blank of approximately 125,000–160,000 psi. As the foregoing materials are sufficiently ductile, they can continue to be cold-worked as the initial hardening process has not made them unworkable by present day tools. After the first cold reduction process has been completed, the head is formed by cold working. This may include stamping, as additional cold working imparts additional hardening to the parts so worked. In this case, it is the head of the fastener that is so hardened. Preferably the initial hardening process does not take the fastener blank beyond the realm of additional cold working, allowing the head to be cold forged with its accompanying additional hardening in the head-forming step.

Once the head has been formed, the remaining shank of the fastener is then cold reduced in a reduction process to reduce it an additional twenty to thirty percent (20%–30%), imparting an approximately forty-five to fifty-two percent (45%–52%) overall cold reduction for the entire formed fastener. The cold forging of the remaining shank portion may include some cutting or drawing. It should be understood that the head forming step and shank reduction may be accomplished in the same step, as opposed to two separate steps.

Once the fastener has been initially formed after the process described, it may achieve an overall tensile strength of over 250,000 psi. Heating the now-formed fastener in an approximate temperature range of 800° F. to 1200° F. (425° C. to 650° C.), the fastener can be further strengthened to obtain hardnesses on the order of to 260,000–280,000 psi.

OBJECTS OF THE INVENTION

It is an object of the present invention to provide a fastener of designated material that is hard and able to endure rugged and/or extreme environments without disintegrating.

It is an object of the present invention to provide a durable and stress-bearing bolt for an internal combustion engine connecting rod.

It is an object of the present invention to provide a method by which such a fastener may be achieved.

It is yet another object of the present invention to provide a method that allows the cold working of a head upon the fastener without reliance upon hot forging.

It is yet another object of the present invention to fashion a fastener of specific disclosed materials that optimizes the hardness available through cold forging for the fastener, with subsequent heat treatment thereof.

These and other objects and the advantages of the present invention will be apparent from the review of the following specification and accompanying drawings.

DESCRIPTION OF THE PREFERRED EMBODIMENTS

Figure 1:
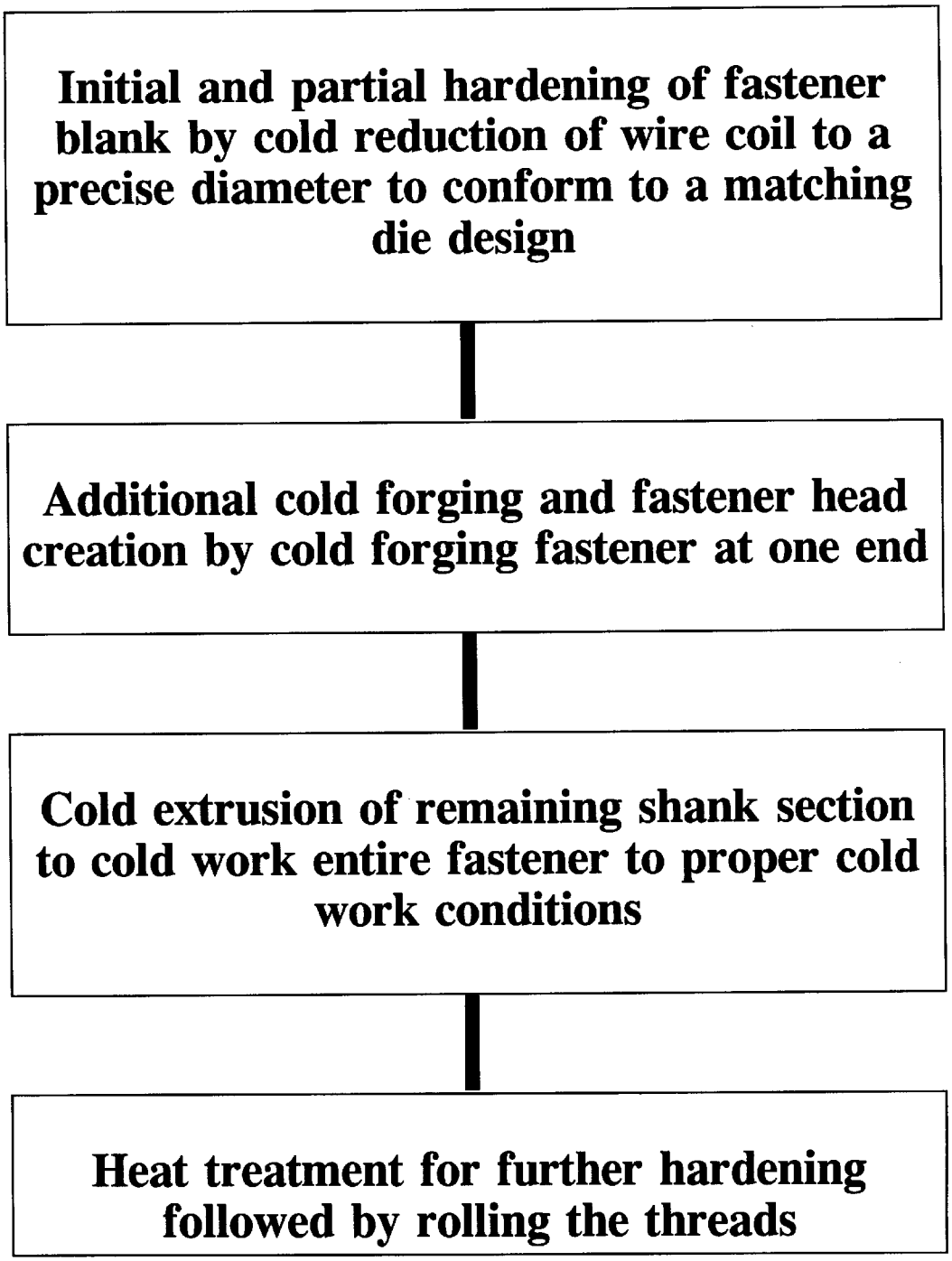
FIG. 1 is a block diagram showing the steps of one embodiment of the method of the invention in sequential order. It should be understood that cold forging of the shank portion and head formation of the fastener may be accomplished in but a single step.

The present invention resides in the creation of a hard fastener able to withstand extreme environments and rigorous stresses. Materials from which such a hardened fastener may be constructed are known, but heretofore could not be as optimally used as cold forging deprived the material of the ability to be further worked to provide fastener heads and the like. With the realization of the present method, this obstacle, as well as others, have been overcome to deliver a fastener that realizes maximum hardness through cold working at both its shank and head ends.

The purveyor of the wire or stock, from which a fastener in accordance with this invention is produced, will cold reduce the stack to a prescribed percentage and exact size to match the size of the die used in the manufacture of the fastener.

In order to forge a material, it is necessary to use a force which exceeds the yield strength as below this yield strength, the material is elastic and reverts back to its original shape once the forging force is removed. As the cobalt-nickel-chromium-molybdenum alloys, as preferably used in the present invention, achieve a yield strength of approximately 200,000 psi upon being cold worked forty-eight to fifty-two percent (48%–52%), this yield strength is too high to cold work into the material a fastener head such as a hexagon, double hexagon, or other fastener head shape.

Materials from which such a hardened fastener can be made are those that maintain their ductility during the hardening process. This ductility, or malleability, is important as the hardening process sometimes tends to make the materials brittle. Such embrittled materials may then disintegrate or suffer catastrophic destruction when stresses are applied even though the material is hard. It is important that the material undergoing the hardening process maintain its cohesion so that it does not surrender by destruction to the hardening process. The material must not be so strong that the forging die material cannot withstand the force needed for further work or move the material.

Therefore, it becomes an important point to choose with particularity the materials that are used to construct the fastener blank before it is cold-forged. In the preferred embodiment of the present invention, known materials such as Custom Age 625 PLUS®, MP35N, and MP159, conforming to the chemistry of AMS 5844 and AMS 5842 standard alloys are used. Other materials showing similar ductility at similar yield strengths as these materials might also be used with good advantage.

These materials, when annealed, generally have tensile strengths below 150,000 psi. At such tensile strengths, these materials are considered soft and generally have a face-centered cubic (FCC) crystal structure with respect to the MP35N and MP159 materials. Cold working converts some of these FCC crystals to close-packed hexagonal (CPH) crystal structures. By cold working these alloys, tensile strengths of over 250,000 psi can be achieved. These high strengths are further fortified by heating below the melting point, generally in the range of 800° F. to 1200° F. (approximately 425° C. to 650° C.). After such heating, these materials may obtain strengths of up to 260,000–280,000 psi. Other materials such as Custom Age do not exhibit FCC crystal transformation.

When these alloys are cold worked to such high strengths, it then becomes a difficult task to form the hardened metals into useful structures as the tools used in cold forging are generally those that work best on softer materials. Generally, the hardened metals are harder than the tools which are supposed to work upon such hardened metals. Instead of the tools working on the metals, the metals begin to work on the tools and the process of attempting to forge a hardened fastener fails as the fastener cannot be formed due to the hardness of the fastener material and its inability to be worked.

However, it is possible to work harden metals so long as they are not too hard. While the alloys still have yield strengths in the range of approximately 125,000–160,000 psi, they can still be worked so long as the ductility of the materials is maintained, per above.

By taking the blank from which the ultimate hardened fastener is to be made, it can be initially cold forged to a hardness surpassing that of its original, soft, FCC condition. When so hardened, any additional cold working will then raise the hardness of the material beyond that originally achieved in the initial and partial hardening of the fastener by cold forging step 10 as shown in FIG. 1.

Generally, in order to obtain this initial hardness, the material must be reduced on the order of twenty to thirty percent (20%–30%). After being so cold reduced, the fastener blank is then ready for the creation of the fastener head at one end.

Additional cold working of one end of the fastener 20 can create a fastener head at one end of the fastener 20. This step is generally known to those of ordinary skill in the art and may include die-pressing, or other additional cold forming and/or forging heading techniques known in the art. Heads that may be achieved for the fastener in this process may include Allen or hex-type nut heads, bolt heads, screw, or other type of heads. Heads having a hexagonal and a double hexagonal shape may also be realized through the fastener head creation step 20. While the fastener head end of the fastener blank is cold forged to form the head, the remaining end of the fastener becomes the shank. The shank of the fastener is that portion of it which actually passes through the two parts held together by the fastener. It is therefore very important that this portion also be hardened to the extent possible as it may be the load-bearing portion of the fastener.

In an alternative embodiment, materials cold reduced to the total amount necessary to achieve high strength may be further processed by hot forging to overcome the high yield strength, thus resulting in a sacrifice of ultimate head hardness due to the hot forge process.

Once the fastener head has been created 20, the remaining shank section is cold-forged so that the entire fastener has been cold forged. An additional twenty to thirty percent (20%–30%) reduction in the fastener blank is achieved by this process. Optimally, the fastener head creation process 20 also causes an increase in strength or hardness by cold working the fastener head end. Thus, further cold forging the head allows the achievement of greater hardness than in the initial hardening process 10, and avoiding a hot-forge process which would soften the fastener head.

If the fastener head is a load-bearing portion of the fastener, the head's hardness becomes a distinctly advantageous feature of the present invention. With increased head hardness and, in the case of a bolt-type fastener, an increased hardness nut, an extremely sturdy and reliable fastener is formed that securely holds the attached members together. However, as the shank may be the portion of the fastener bearing the most load, a head resulting from a hot-forge process may not detract from the fastener formed by the present inventive method.

After the cold forging of the shank section 30, and after further thermal treatment, threads or the like are formed into the shank by thread rolling processes.

This fastener so forged has undergone a reduction of approximately forty-eight to fifty percent (48%–50%). In so doing, soft, generally face-centered cubic (FCC) material having a tensile of strength below 150,000 psi has been brought to a hardened state with cold forging with some of the FCC phase converted to closed-pack hexagonal (CPH) crystal structure. Additionally, the cold-forged material now has a tensile strength of generally at least 250,000 psi. Due to the nature of the cold forging processes 10, 20, 30 involved, the method of the present invention may be achieved through highly automated and mechanical processes, allowing for high production rates of cold-forged and extremely hard fasteners.

Once the fasteners have been formed, it is possible to achieve additional strengthening by heating the fasteners in a temperature range of approximately 800° F. to 1200° F. (425° C. to 650° C.) for the disclosed AMS Standard materials fasteners and 1200° F. to 1400° F. for the Custom Age 625 Plush® alloy material fasteners. This heat should be maintained until thermal equilibrium is reached within the fastener and thereafter until maximum strengthening is achieved, generally on the order of several hours, as it is known in the art. Next the threads may be rolled.

Upon completing the heat treatment step 40 of the twice-forged fastener, the hardened fastener of the present invention is then ready for use. Appropriate selection of the size of the blank is important at the outset to ensure that the resulting cold-forged fastener is of the proper size and shape.

In the case of materials that may be initially hardened by other means and additionally hardened by cold reduction, the method of the present invention may be adapted to accommodate alternative hardening means. In the case of Custom Age 625 PLUS® alloy, solution treating, aging, and/or heat treating can bring a fastener blank made of such material to an initial hardness.

Other materials may also beneficially and advantageously implement the method of the present invention by undergoing an initial hardening process, followed by additional cold forging steps to bring forth the maximum available hardness in the fastener material.

While the present invention has been described with regards to particular embodiments, it is recognized that additional variations of the present inventive method may be devised without departing from the inventive concept embodied therein.

What is claimed is:

1. A method for forming a durable fastener comprising the steps of:

a) providing fastener material;

b) initially cold reducing said fastener material to approximately one half of a total reduction and forming a fastener blank;

c) thereafter providing a fastener head upon said fastener blank by cold working said fastener blank at one end;

d) subsequently cold reducing in a second step a second and shank end of said fastener blank opposite said fastener head, said cold reduction approximately a remaining half of said total reduction to form the fastener; and e) recovering a formed fastener whereby said fastener blank is strengthened and cold worked after the initial step, said fastener head is worked upon said strengthened fastener blank to provide an additionally-strengthened fastener head, and said shank is fully cold forged for optimum hardness to provide a durable cold-forged fastener with high hardness.

2. The method of claim 1, wherein the step of providing fastener material further comprises providing a fastener blank of cobalt-nickel-chromium-molybdenum alloy and further comprises forming threads in the said shank end between steps d) and e).

3. The method for forming a durable fastener of claim 1, wherein said cobalt-nickel-chromium-molybdenum alloy conforms to AMS 5844 and AMS 5842 chemistry.

4. The method for forming a durable fastener of claim 2, wherein said cobalt-nickel-chromium-molybdenum alloy is defined by AMS 5844.

5. The method for forming a durable fastener of claim 2, wherein said cobalt-nickel-chromium-molybdenum alloy is defined by AMS 5842.

6. The method for forming a durable fastener of claim 1, wherein said first process reduces said fastener blank approximately 20%–30%.

7. The method for forming a durable fastener of claim 6, wherein a yield strength of said fastener blank after said first process is approximately 125,000 psi to 160,000 psi.

8. The method for forming a durable fastener of claim 1, wherein said third process reduces said fastener blank shank approximately an additional 20%–30%.

9. The method for forming a durable fastener of claim 1, wherein said fastener blank is reduced approximately 48%–50%.

10. The method for forming a durable fastener of claim 1, wherein the method further comprises:

heating said fastener blank between steps c) and d); whereby additional hardness is imparted to the fastener and thereafter rolling threads on said blank after step d).

11. The method for forming a durable fastener of claim 10, wherein the method of heating said fastener blank comprises heating said fastener blank in a temperature range of 800° F. to 1200° F. (approximately 425° C. to 650° C.).

12. A fastener formed by the method of claim 1.

13. A method for forming a durable fastener, the steps comprising:

providing a fastener blank;

cold reducing said fastener blank approximately 20%–30% so that a yield strength of said fastener blank after said cold reducing is approximately 125,000 psi to 160,000 psi to initially harden said fastener blank;

providing a fastener head upon said initially-hardened fastener blank by cold working said fastener blank at one end and in so doing, cold working said end and head to increase hardness of said end and said head;

cold reducing a second and shank end of said fastener blank opposite said fastener head, said cold reduction approximately an additional 20%–30% of said fastener blank for a total cold reduction of approximately 48%–50%; and heating said fastener blank in a temperature range of 800° F. to 1200° F. (approximately 425° C. to 650° C.) to impart additional hardness to the fastener; whereby said fastener blank is strengthened and cold worked after said first process, said fastener head is worked upon said strengthened fastener blank to provide an additionally-strengthened fastener head, said shank is fully cold forged for optimum hardness to provide a durable cold-forged fastener with high hardness and has threads rolled therein, and said heating increasing tensile strength of the fastener to approximately 260,000 psi to 280,000 psi.

14. The fastener formed by the method of claim 13.

15. The method for forming a durable fastener of claim 13, wherein the step of providing a fastener blank further comprises providing a fastener blank of cobalt-nickel-chromium-molybdenum alloy.

16. The method for forming a durable fastener of claim 15, wherein said cobalt-nickel-chromium-molybdenum alloy is defined by AMS 5844 chemistry.

17. The method for forming a durable fastener of claim 15, wherein said cobalt-nickel-chromium-molybdenum alloy is defined by AMS 5842 chemistry.

18. A method for forming a durable fastener, the steps comprising;

providing a fastener blank of suitable material having an initial cold draft of 16–36% and a tensile strength of between 150,000–210,000 psi; and sequentially performing the following steps:

a) initially hardening said fastener blank in a hardening process;

b) providing a fastener head upon said fastener blank by cold working said fastener blank at one end; and c) cold reducing a second and shank end of said fastener blank opposite said fastener head, said cold reduction approximately a remaining half of said total reduction to form the fastener; whereby said fastener blank is strengthened and cold worked after the initial hardening process, said fastener head is worked upon said strengthened fastener blank to provide an additionally-strengthened fastener head, and said shank is fully cold forged for optimum hardness to provide a durable cold-forged fastener with high hardness.

19. The method for forming a durable fastener of claim 18, wherein the initial hardening process step is selected from the group consisting of:

heat treatment, solution treatment, cold forging, and aging.

20. The method for forming a durable fastener of claim 19, wherein the step of providing a fastener blank further comprises providing a fastener blank of cobalt-nickel-chromium-molybdenum alloy.

21. The method for forming a durable fastener of claim 20, wherein said cobalt-nickel-chromium-molybdenum alloy is defined by AMS 5844 chemistry.

22. The method for forming a durable fastener of claim 20, wherein said cobalt-nickel-chromium-molybdenum alloy is defined by AMS 5842 chemistry.

23. The method for forming a durable fastener of claim 20, wherein said cobalt-nickel-chromium-molybdenum alloy is defined by AMS 5842 chemistry.

24. The method for forming a durable fastener of claim 19, wherein the step of providing a fastener blank further comprises providing a fastener blank of Custom Age 625 PLUS® alloy and where the initial material has a 14%–30% cold reduction, a tensile strength of 140,000–200,000 psi, and a yield strength of 100,000–150,000 psi.

25. The method for forming a durable fastener of claim 19, wherein the initial process step reduces said fastener blank approximately 14%–30%.

26. The method for forming a durable fastener of claim 19, wherein a yield strength of said fastener blank after the initial process is approximately 125,000 psi to 160,000 psi.

27. The method for forming a durable fastener of claim 19, wherein the cold reducing of said second and shank end of said fastener reduces said fastener blank shank approximately an additional 20%–30% and threads are rolled therein.

28. The method for forming a durable fastener of claim 19, wherein said fastener blank is reduced approximately 48%–50%.

29. The method for forming a durable fastener of claim 19, wherein the steps further comprise:

heating said fastener blank after said third process step; whereby additional hardness is imparted to the fastener.

30. The method for forming a durable fastener of claim 29, wherein the step of heating said fastener blank comprises heating said fastener blank in a temperature range of 800° F. to 1200° F. (approximately 425° C. to 650° C.).

31. A fastener formed by the method of claim 19.

32. A connecting rod bolt formed by the method of claim 19.

* * * * *